United States Patent [19]

Hasler et al.

[11] Patent Number: 4,629,465

[45] Date of Patent: Dec. 16, 1986

[54] PROCESS FOR EXHAUST DYEING A TEXTILE FIBER MATERIAL: CONTROLLED ADDITION OF DYE OR ELECTROLYTE

[75] Inventors: Rolf Hasler, Bottmingen, Switzerland; Francis Palacin, Riedisheim, France

[73] Assignee: Sandoz Ltd., Basel, Switzerland

[21] Appl. No.: 656,615

[22] Filed: Oct. 1, 1984

[30] Foreign Application Priority Data

Oct. 1, 1983 [DE] Fed. Rep. of Germany ..... 3335828

[51] Int. Cl.[4] ..... D06B 23/28; D06P 3/60

[52] U.S. Cl. ..... 8/400; 8/534; 8/539; 8/654; 8/676; 8/680; 8/917; 8/918; 8/922; 8/924; 8/927

[58] Field of Search ..... 8/400, 534, 654

[56] References Cited

U.S. PATENT DOCUMENTS 4,089,644 5/1978 Carbonell et al. ..... 8/400
4,125,371 11/1978 Beutler et al. ..... 8/400
4,372,744 2/1983 Hildebrand et al. ..... 8/400

FOREIGN PATENT DOCUMENTS 1458632 12/1976 United Kingdom .

OTHER PUBLICATIONS

Dullaghan and Ultee, Textile Research Journal, 1973, pp. 10–18.

*Primary Examiner*—A. Lionel Clingman
*Attorney, Agent, or Firm*—Gerald D. Sharkin; Richard E. Vila; Thomas C. Doyle

[57] ABSTRACT

The invention relates to a process for exhaust dyeing a textile fibre substrate to obtain level dyeings, which process comprises the step of adding to the dyebath the effective amount of dyestuff or electrolyte or dyestuff and electrolyte either simultaneously or one after the other in specified quantities per cycle of the dyeing machine, metered according to a mathematical function.

21 Claims, 2 Drawing Figures

Figure 1:
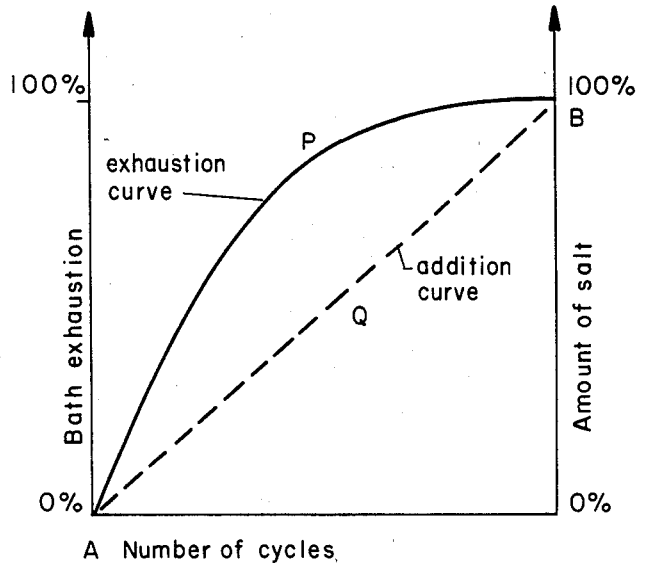

PROCESS FOR EXHAUST DYEING A TEXTILE FIBER MATERIAL: CONTROLLED ADDITION OF DYE OR ELECTROLYTE

The invention relates to an exhaust dyeing process of textile fibre material.

A particular difficulty often experienced with exhaust dyeing is the production of unlevel dyeings. They are often due to distribution problems of the dyestuff and/or electrolyte when they are added to the dyebath. A further problem arising in exhaust dyeing is the need for reproducible dyeings so that they can be produced in a more economical way and be fully automated. Various attempts have been made to overcome these problems. However, the proposed solutions have still left much to be desired.

It has now been found that good exhaust dyeing results are obtained when the dyestuff and/or electrolyte are added in specified quantities to the dyebath, taking into account the mechanical characteristics of the dyeing machine used.

Accordingly, the present invention provides a process for exhaust dyeing a textile fibre substrate which comprises the step of adding to the dyebath the effective amount of dyestuff or electrolyte or dyestuff and electrolyte either simultaneously or one after the other in specified quantities per cycle of the dyeing machine, metered according to a mathematical function.

In the process of the invention, the dyestuff and/or the electrolyte are added to the dyebath in small divided quantities per cycle. These repeatedly added quantities may be equal when the mathematical function is linear, or may vary according to a positive or negative exponential, logarithmic or power function. Preferably the addition is steered according to an exponential or linear function.

The mathematical function used according to the invention for steering the addition of the dyestuff and/or electrolyte is preferably selected such as to achieve substantially linear exhaustion of the dyebath, i.e. a constant percentage of the dyestuff amount is built up on the substrate per cycle. The adsorption rate of the dyestuffs depends on the dyestuffs used, the substrate to be dyed and further parameters such as the temperature, the pH, the concentration of salt and also the technical characteristics of the dyeing machine employed. A series of exhaust dyeing test runs are effected employing the substrate and also the dye and electrolyte intended to be employed in the production process. For example, the tests are effected by first fixing the parameters other than the addition of the dyestuff and/or electrolyte. The dyestuff or the electrolyte is then added at a linear rate and the dyebath exhaustion is simultaneously monitored. The resulting exhaustion is represented on a graph as a function of the number of cycles of the dyebath and/or substrate. The linear addition of the dyestuff or the electrolyte is also represented on the same graph as a function of the number of cycles of the dyebath and/or substrate, the quantities of dyestuff or electrolyte added being expressed as a percentage of the total amount of dyestuff or electrolyte required for the dyeing.

Figure 2:
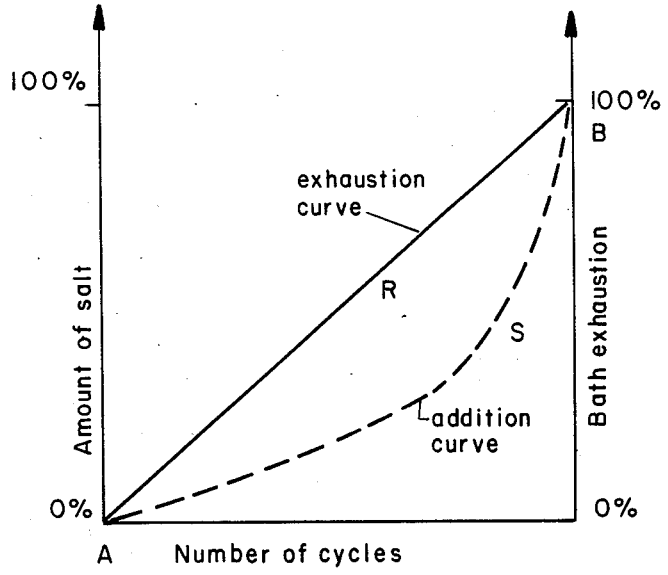

Thus for example in FIG. 1 the line APB is the observed exhausting curve as a function of the number of cycles in a test run in which salt is added at a constant rate per cycle as represented by the linear curve AQB. To a first approximation, the addition curve required to obtain a linear exhaustion curve is obtained by plotting a curve ASB (FIG. 2) which has reflection symmetry with APB about the straight line AQB. The x, y coordinates of a number of points on the line ASB may then be used to calculate a mathematical function defining the curve ASB to any desired degree of accuracy. This calculation is conveniently done on a data processing unit such as a desktop computer.

Having determined this function, the process is rerun metering the dyestuff or the electrolyte accordingly and the levelness of the resulting dyeing is scrutinized. If necessary, this procedure may be repeated varying the addition of the dyestuff or the electrolyte until the desired linear exhaust is obtained. The mathematical function corresponding to the final form of the addition curve may then be employed in the program of a computer-controlled production process.

When a mixture of dyestuffs is used, the test runs which are effected for determining the mathematical function are advantageously based on the dyestuff having the highest exhaustion rate.

By "cycle" of the dyeing machine is meant a time interval which takes into account the movement of the dyebath and/or the movement of the substrate, depending on the kind of machine used. It is defined by the number of contacts bath/substrate during the dyeing process (see for example "Chemiefaser/Textilindustrie" 26, 78, 1976, page 901 or "Meliand Textilberichte", 54, 1973, pages 68–77).

A particular preferred exhaust dyeing process according to the invention is the metering of the dyestuff and/or electrolyte at such a rate following one of the above mentioned mathematical function that the dyestuff is built up on the substrate (or the dyebath is exhausted) at a linear rate of about 1%, preferably 1%, based on the total dyestuff concentration used for the dyeing, per cycle.

According to the process of the invention, either the dyestuff alone is metered into the dyebath which already contains the electrolyte, or the electrolyte alone is metered into the dyebath which contains the dyestuff, or the dyestuff and electrolyte are metered into the dyebath one after the other or simultaneously, e.g. with two metering devices. The dyestuff added according to the invention may be a single dyestuff or a mixture of dyestuffs. For example, when the substrate is a blend of fibres having various dye affinities, the dyestuffs for each type of fibre may be added in admixture as a single entity or one after substantial exhaustion of the other.

Suitable electrolytes are salts, e.g. sodium or potassium sulphate or chloride, acids, e.g. formic or acetic acid, or an agent having an alkaline action e.g. sodium or potassium hydroxide, carbonate, bicarbonate or silicate, borax, or trisodium or tripotassium phosphate, depending on the type of dyestuffs used. When reactive dyestuffs are used for dyeing, either the salt such as sodium sulphate or chloride, is added according to the invention to the dyebath which already contains the dyestuffs and the alkaline compound, e.g. sodium carbonate, or the addition of salt to the dyebath containing the dyestuff takes place first and is then followed by the addition of the alkaline compound, each addition being carried out according to the invention, or the dyestuff first and then the alkaline compound are metered according to the invention into the dyebath containing the salt.

The dyestuffs and the electrolytes may, when they exist in solid form, be added as such, e.g. as a powder.

Preferably they are metered into the dyebath in liquid form, particularly in the form of an aqueous or organic solution.

The dyebath used in the process of the invention may contain further conventional ingredients such as a dispersing agent, a wetting agent, an emulsifying agent or a softening agent. The dyebath may be aqueous or produced from organic solvents which are optionally mixed with water. Such solvents may comprise any of the known solvents used in dyeing processes.

The process of the invention is in general suitable for all kinds of textile substrates e.g. textile fibre material consisting of cotton, wool or silk, of synthetic yarns or fibres of polyolefines, polyvinyl chloride, polyvinyl acetate, polyvinyl alcohol, polyvinyl ether, polyacrylonitrile, polyurethanes, polyamides (including modified polyamide fibres), or polyesters as well as semisynthetic materials such as cellulose acetates or regenerated cellulose. Blends of these textile fibres are also dyeable according to the process of the invention.

Suitable dyestuffs which may be used in the process of the invention include acid dyestuffs, direct dyestuffs, reactive dyestuffs, basic dyestuffs, sulphur dyestuffs, disperse dyestuffs. Such dyestuffs are known, e.g. from the Colour Index, and may belong to the class of monoazo, diazo or polyazo dyestuffs, anthraquinone dyestuffs, phthalocyanine metal dyestuffs, nitro dyestuffs, dioxazines dyestuffs, metal complex dyestuffs, e.g. 1:1 or 1:2 metal complexes, metallizable dyestuffs, methine, polymethine and azomethine dyestuffs. The word "dyestuff" also embraces optical brightening agents.

It is to be understood that the type of dyestuff employed is matched to the textiles to be dyed.

The goods to liquor ratio may advantageously be within 1:1 and 1:60, preferably from 1:4 to 1:30.

When the electrolyte added portionwise according to the invention is a salt, e.g. a salt such as sodium sulphate or chloride used for dyeing with sulphur, reactive or direct dyestuffs, it is advantageously added in a total amount ranging from 0.5 to 200 g/l, preferably from 0.5 to 100 g/l.

The exhaust dyeing process of the invention is conveniently carried out at a temperature from 20° C. to 150° C., preferably from 30° C. to 100° C. After the dyestuff has been sufficiently adsorbed on the substrate, the substrate may, if desired, be further treated in conventional manner, e.g. by maintaining the same temperature as at the end of the metering step, or heating to a higher temperature, e.g. between 100° and 160° C., to improve or complete fixation. The further treatment of the resulting dyeings, e.g. rinsing, washing and drying, may be carried out according to known methods.

During the metering step, either the temperature of the dyebath may be raised, e.g. by heating according to a linear rate, or it may be maintained constant, in particular when metering the salt or dyestuff.

In general, the process of the invention may be employed with all known exhaust dyeing apparatus which operate on a short or long liquor ratio principle. Examples are cheese and cone dyeing machines, beam dyeing machines, jigs, jet dyeing machines, winch becks, paddle dyeing machines, packing machines, rotary dyeing machines and hank dyeing machines.

In a preferred embodiment of the invention, the dyestuff is added at the beginning to the dyebath and only the electrolyte is metered according to one of the above mentioned mathematical functions, preferably according to an exponential or linear function.

The process of the invention is particularly preferred for exhaust dyeing of cellulosic fibre material, preferably cotton, with direct, reactive or sulphur dyestuffs.

The exhaust dyeing process of the invention enables the production of level and reproducible dyeings with a good tinctorial yield. In particular by metering the electrolyte into the dyebath, at each addition the electrolyte is just present at the concentration required for adsorption and fixation of the dyestuff on the substrate without exerting any deleterious effect. Furthermore, the dyeing process can be fully automated and monitored by computer.

The following Examples, in which all parts and percentages are by weight, illustrate the invention. The temperatures are in degrees Centigrade.

EXAMPLE 1

100 Parts cotton yarn in cheese form are introduced in a cheese and cone dyeing machine containing 1 part of the dyestuff C.I. Direct Blue 77 in 700 parts water at 30°. This dyeing machine has a dyebath flow rate of 3 complete circulations of the complete dyebath volume per minute, i.e. of 3 cycles.

The dyebath is heated to the boil with a heating rate of 2,5°/min. During the heating period, a solution of 7 parts sodium chloride in 70 parts water is metered into the dyebath according to an exponential function. The volume of salt solution is added in small quantities over 80 cycles.

After completion of the salt addition, the yarn is further treated at the boil for 45 minutes. After cooling to 80°, the dyebath is discharged and the yarn is treated according to known methods.

A yarn dyed in a level blue shade is thus obtained.

EXAMPLE 2

100 Parts cotton knitted goods are introduced in a jet dyeing machine which is charged with a dyebath at 30° containing 0.4 parts of the dyestuff C.I. Direct Yellow 98, 0.35 parts of the dyestuff C.I. Direct Red 83 and 0.3 parts of the dyestuff C.I. Direct Blue 77 in 1000 parts water.

The dyebath is heated to 98° over a period of 30 minutes. During this period which corresponds to 80 contacts dyebath/substrate, a solution of 10 parts sodium chloride in 100 parts water is added to the dyebath according to an exponential function.

After addition of the salt solution, the substrate is further treated at the boil for 45 minutes. After cooling to 80°, the dyebath is discharged and the substrate is rinsed and dried according to known methods.

Knitted goods dyed in a level grey shade are thus obtained.

EXAMPLE 3

100 Parts cotton yarn in cheese form are introduced in a cheese and cone dyeing machine. The machine is charged at 25° with a liquor containing 2 parts of the dyestuff C.I. Reactive Yellow 25, 0.5 parts of the dyestuff C.I. Reactive Blue 104 and 2 parts of the dyestuff C.I. Reactive Green 21 in 750 parts water. The dyebath flow rate in the dyeing machine is 2 complete circulations of the complete dyebath volume per minute which corresponds to 2 cycles per minute.

The dyebath is heated to 40° at a rate of 1°/min. During this period, a solution of 50 parts sodium sulphate in 250 parts water is added to the dyebath according to an exponential function distributed over 30 cycles.

After addition of the salt, the yarn is further treated in the machine at 40° for 15 minutes. Thereafter a solution of 20 parts sodium carbonate in 100 parts water is injected in small quantities according to an exponential function over 60 cycles. After completion, the yarn is further treated at 40° to 45 minutes and then rinsed and dried according to known methods.

Dyeings in a level penetrating shade are thus obtained.

EXAMPLE 4

On a cheese and cone dyeing machine, 100 parts of a texturised polyamide 6.6 yarn are dyed in 1000 parts of an aqueous liquor containing 2 parts of the dyestuff C.I. Acid Blue 280. The pH of the dyebath is reduced at a constant temperature of 60° over a period of 60 cycles from 7.0 to 3.5 by addition of acetic acid and formic acid as follows:

TABLE 1

| number of cycles | 0 | 10 | 20 | 30 | 40 | 50 | 60 |
|---|---|---|---|---|---|---|---|
| pH value | 7 | 6.8 | 6.4 | 5.9 | 5.3 | 4.5 | 3.5 |

After reaching a pH value of 3.5 the dyebath is heated to 98° over a period of 10 cycles and the polyamide yarn is treated at 98° over the course of further 30 cycles.

After cooling to 75° and discharging the dyebath, the substrate is washed and dried according to known methods.

A yarn dyed in a level blue shade with good fastnesses is thus obtained.

EXAMPLE 5

100 Parts cotton knitted goods are introduced in a jet dyeing machine. The machine is charged with 1900 parts water at 40°, 0.18 parts of the dyestuff C.I. Direct Yellow 162, 0.16 parts of the dyestuff of Example 4 of UK Patent Specification 2 122 634 and 0.115 parts of the dyestuff C.I. Direct Black 118. The machine operates at 2.5 cycles per minute (2.5 contacts between the substrate and the dyebath/minute).

The dyebath is heated to 98° over a period of 45 minutes. During this period, a solution of 16 parts sodium chloride in 100 parts water is injected stepwise in the circulating dyebath according to the following rate:

TABLE 2

| step No. | 1 | 2 | 3 | 4 | 5 | 6 | 7 | 8 | 9 | 10 |
|---|---|---|---|---|---|---|---|---|---|---|
| intervals (cycle) | 22.5 | 20 | 17.5 | 12.5 | 11.25 | 8.75 | 6.25 | 5 | 3.75 | 2.5 |
| metering rate (salt parts/cycle) | 0.072 | 0.08 | 0.088 | 0.12 | 0.144 | 0.192 | 0.24 | 0.32 | 0.432 | 0.688 |
| total injected salt amount (parts) | 1.62 | 3.22 | 4.76 | 6.26 | 7.88 | 9.56 | 11.06 | 12.66 | 14.28 | 16.00 |

In each step the metering rate is constant. When represented on a graph, the total salt addition follows the exponential function $y=0.02x^{1.41}$ ($y$=amount of salt metered; $\times$=number of cycles). These results are determined from the exhaustion curve based on the first exhausting dyestuff and corresponding to a linear addition of 0.073 parts salt per liter per cycle to the dyebath under the same conditions as disclosed above. The addition of salt according to the exponential function gives an exhaustion rate of approx. 0.9% per cycle.

The substrate is then further treated at the boil for 20 minutes. After cooling to 80° and discharging the dyebath, the cotton substrate is rinsed and dried.

Knitted goods dyed in a level brown shade are thus obtained.

EXAMPLE 6

100 Parts of cotton yarn in cheese form are introduced in a cheese and cone dyeing machine. The machine is charged with a liquor at 40° containing 3 parts of the dyestuff C.I. Direct Blue 251 in 700 parts water and operates at a dyebath flow rate of 2.5 complete circulations per minute, i.e. 2.5 cycles per minute.

The dyebath is heated to 98° at a heating rate of 2°/min. During this period, a solution of 15 parts sodium chloride in 100 parts water is injected in small quantities into the dyebath at a constant rate over approx. 75 cycles.

The cotton yarn is then further treated at the boil for 45 minutes. After cooling to 80° and discharging the dyebath, the cotton yarn is rinsed and dried according to known methods.

The yarn cheeses are thoroughly dyed in a level navy blue shade.

EXAMPLE 7

100 Parts of cotton yarn in cheese form are introduced in a cheese and cone dyeing machine. The machine is charged with a liquor at 40° containing 3 parts of a commercially available antioxidant in 600 parts water and works at a flow rate of 3 cycles per minute.

A solution of 12 parts of the dyestuff C.I. Leuco Sulphur Red 10 in 100 parts water is added in small quantities at a constant rate (linear function) over 60 cycles. The dyebath is then heated to 60° at a heating rate of 30°/min.

A solution of 8 parts sodium sulphate in 80 parts water is injected in small quantities at a constant rate (linear function) over 90 cycles at 60°. The substrate is further treated at 60° over 15 minutes. After discharging the dyebath, the substrate is rinsed, oxidised and soaped according to known methods.

A red-brown dyeing with excellent levelness throughout the cheese is thus obtained.

What is claimed is:

1. In a process in which a textile fiber substrate is exhaust dyed with an effective amount of a direct, reactive or sulfur dyestuff in a dyebath which also contains an effective amount of electrolyte selected from the group consisting of salts and agents having an alkaline action, the improvement which comprises adding the effective amount of said dyestuff or said electrolyte, or the effective amounts of said dyestuff and said electrolyte simultaneously or one after the other, to the dyebath in specified quantities metered, per cycle of the dyeing machine, according to a linear or exponential function such as to give a substantially linear exhaustion of the dyebath.

2. A process according to claim 1, in which the dyestuff or the electrolyte or both are metered according to such a function that the dyebath is exhausted at a linear rate of approx. 1%, based on the total dyestuff concentration used for the dyeing, per cycle.

3. A process according to claim 1, in which the dyestuff is selected from the group consisting of monoazo, diazo or polyazo dyestuffs, anthraquinone dyestuffs, phthalocyanine metal dyestuffs, nitro dyestuffs, dioxazine dyestuffs, metal complex dyestuffs, metallizable dyestuffs and methine, polymethine and azomethine dyestuffs.

4. A process according to claim 1, in which either the dyestuff alone is metered into the dyebath containing the electrolyte, or the electrolyte alone is metered into the dyebath containing the dyestuff.

5. A process according to claim 1, in which the dyestuff and the electrolyte are metered each into the dyebath one after the other.

6. A process according to claim 1, in which the dyestuff is a direct or sulphur dyestuff and the electrolyte is a salt.

7. A process according to claim 1, in which the dyestuff is a reactive dyestuff and the electrolyte comprises both a salt and an agent having an alkaline action.

8. A process according to claim 7, in which either the salt is metered into the dyebath containing the dyestuff and the agent having an alkaline action, or the salt and then the agent having an alkaline action are metered one after the other into the dyebath containing the dyestuff, or the dyestuff and then the agent having an alkaline action are metered one after the other into the dyebath containing the salt.

9. A process according to claim 1 in which the substrate to dyebath ratio is from 1:1 to 1:60.

10. A process according to claim 1, in which the textile substrate comprises cotton.

11. A process according to claim 1 wherein the electrolyte is selected from the group consisting of sodium sulphate, sodium chloride, potassium sulphate, potassium chloride, sodium hydroxide, sodium carbonate, sodium bicarbonate, sodium silicate, potassium hydroxide, potassium carbonate, potassium bicarbonate, potassium silicate, borax, trisodium phosphate and tripotassium phosphate.

12. A process according to claim 15 in which the dyestuff is a direct or sulphur dyestuff and the electrolyte is a salt.

13. A process according to claim 1 in which only the electrolyte is metered into the dyebath to which the dyestuff has previously been added.

14. A process according to claim 1 in which the electrolyte is a salt and is added in a total amount in the range 0.5 to 200 g/l.

15. A process according to claim 2 in which only the electrolyte is metered into the dyebath to which the dyestuff has previously been added.

16. A process according to claim 6 in which only the electrolyte is metered into the dyebath to which the dyestuff has previously been added.

17. A process according to claim 1 wherein the dyestuff and/or electrolyte are metered into the dyebath in the form of an aqueous or organic solution.

18. A process according to claim 12 in which the substrate is cotton.

19. A process according to claim 1 in which a cycle comprises one complete circulation of the complete volume of the dyebath.

20. A process according to claim 13 in which a cycle comprises one complete circulation of the complete volume of the dyebath.

21. A process according to claim 12 in which a cycle comprises one complete circulation of the complete volume of the dyebath.

* * * * *